US005771885A

United States Patent [19]

Putrello

[11] Patent Number: 5,771,885

[45] Date of Patent: Jun. 30, 1998

[54] EXERCISE FILTER

[75] Inventor: Andrew C. Putrello, Utica, N.Y.

[73] Assignee: Tri-Pact Enterprises, Inc., Utica, N.Y.

[21] Appl. No.: 605,675

[22] Filed: Feb. 22, 1996

[51] Int. Cl.[6] ..... A62B 7/10

[52] U.S. Cl. ..... 128/205.27; 128/206.15; 128/206.29

[58] Field of Search ..... 128/201.25, 205.27, 128/206.15, 206.17, 206.29

[56] References Cited

U.S. PATENT DOCUMENTS

| | | | |
|---|---|---|---|
| 3,548,823 | 12/1970 | Bogacik | 128/205.29 |
| 4,071,026 | 1/1978 | Bevins | 128/205.29 |
| 4,098,270 | 7/1978 | Dolby | 128/206.12 |
| 4,141,703 | 2/1979 | Mulchi | 128/206.15 |
| 4,231,364 | 11/1980 | Speshyock | 128/206.15 |
| 4,677,976 | 7/1987 | Fujinuma et al. | 128/201.25 |
| 4,688,567 | 8/1987 | Kikuchi et al. | 128/206.15 |
| 5,033,507 | 7/1991 | Pouchot | 128/205.29 |
| 5,080,094 | 1/1992 | Tayebi | 128/205.29 |
| 5,086,768 | 2/1992 | Niemeyer | 128/205.24 |
| 5,226,412 | 7/1993 | Winters | 128/206.12 |
| 5,331,957 | 7/1994 | Liu | 128/206.15 |
| 5,386,825 | 2/1995 | Bates | 128/205.27 |
| 5,427,092 | 6/1995 | Shiao | 128/206.12 |

*Primary Examiner*—Aaron J. Lewis
*Attorney, Agent, or Firm*—Bond, Schoeneck & King, LLP

[57] ABSTRACT

An exercise filter assembly comprises a housing with removable filters and two one-way valves. The filters remove any particulate matter three microns or greater from the air stream. The one-way valves, positioned in a unique manner, prevent undesired air flows from entering an individual's respiratory tract. The filter assembly is comprised of a lightweight sturdy plastic which is easy and comfortable to wear.

20 Claims, 7 Drawing Sheets

EXERCISE FILTER

FIELD OF THE INVENTION

The present invention relates generally to an exercise filter and more specifically to an exercise filter having removable filter cartridges.

BACKGROUND OF THE INVENTION

Respiratory protective devices have been used in the workplace and for exercise purposes for many years. There are a variety of respirators sold in the market today; however, the most common respiration mouthpieces are generally comprised of a filter fastened at a front end or at respective sides thereof by means of an elastic cord.

People who have difficulty breathing, whether due to nasal congestion, common cold, allergies, sinus congestion, smog, or the like, or who have difficulty sleeping, usually depend on these types of prior art respirators or filters.

In addition, people who need to jog or like to jog outdoors but live in polluted areas and are therefore more susceptible to inhaling polluted air also rely on such prior art devices in order to protect themselves from the harmful effects of outdoor exercise in a polluted regions.

Among the reasons for respirator non-use and discomfort are that known respirators contain excessive dead space, known respirators leak, known respirator devices tend to exert undue pressure on sensitive areas of the face or inside the mouth, and that known valves in respirator devices deteriorate quickly.

The dead space problem is perhaps the most difficult to resolve. Respiratory dead space is the volume of air between a respiratory device and the face of an individual wearing the respirator. When the wearer exhales, part of the exhaled air is trapped inside the device. During subsequent inhalation, the trapped air is drawn back into the mouth and nasal passages and begins to enter the lungs before any fresh air can do so. If the dead space is large enough, it is possible that only the air trapped therein will be re-breathed. Because the partial pressure of carbon dioxide exhaled is higher than the partial pressure of carbon dioxide normally inhaled from the atmospheric air, the re-inhaled air which enters the lungs first will contain elevated levels of carbon dioxide. This influx of air mixes with the residue of air which remains in the lungs from the previous exhalation, and as a consequence, raises the overall level of retained carbon dioxide in the lungs.

Another problem which leads to non-use is that respiratory devices have been known to leak. This allows for particles which would otherwise be filtered out of the device to enter into the inhaled airstream, thus subjecting the wearer to harmful pollution and an essentially ineffectual device.

With respect to the undue pressure placed upon the face or inside the mouth, many protective devices are designed to include a mouthpiece which is placed inside the wearer's mouth. A common result with such devices is that the strap or other mechanism which holds a respirator to a person's head draws or pulls the mouthpiece into direct contact with the person's gums and teeth. Over a period of time, the gums become irritated and the teeth shift which results in general discomfort, poor bite, and other mouth problems. Respirators held in place with such an elastic cord also tend to shift from one side to the other thus causing the wearer overall discomfort.

An individual's discomfort is also compounded by the design of the device, in particular, inhalation valves whose shapes are quickly distorted by everyday use. In addition to this, if the respirator or exercise filter is bulky and heavy, added pressure and weight are placed upon an individual's mouth and face, thereby creating an even greater amount of discomfort. Both conditions result in increased dead space and breathing resistance.

The present invention addresses the aforementioned problems with a structural design aimed at minimizing the negative effects, which in turn leads to greater comfort and safety to the individual, and consequently a greater likelihood the individual will wear the exercise filter and realize its benefits.

SUMMARY OF THE INVENTION

The invention is directed to a filter assembly comprising a housing having an inlet port, a first removable filter, a second removable filter, and a first one-way valve in series for unidirectionally allowing flow of air through the body such that air passes through the first filter, the second filter and the first one-way valve; and an exhaust port having a second one-way valve for unidirectionally exhausting air from the body.

DETAILED DESCRIPTION OF THE PREFERRED EMBODIMENTS

Figure 1:
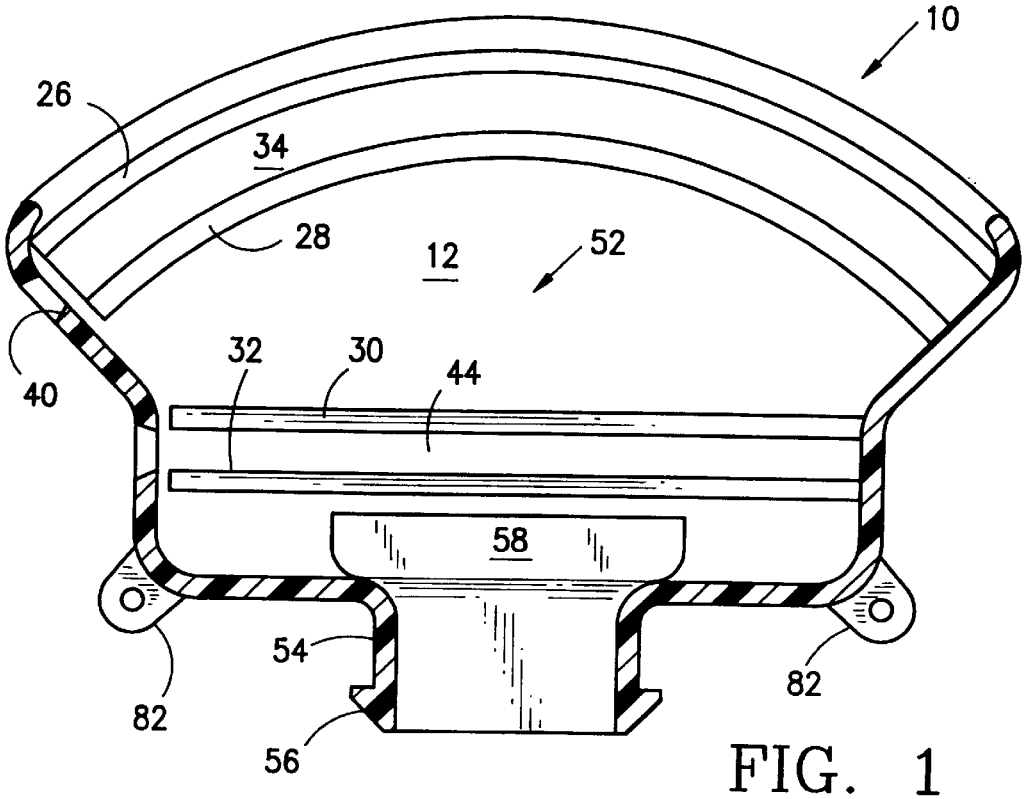
FIG. 1 illustrates a top view of the exercise filter according to the present invention.
Figure 2:
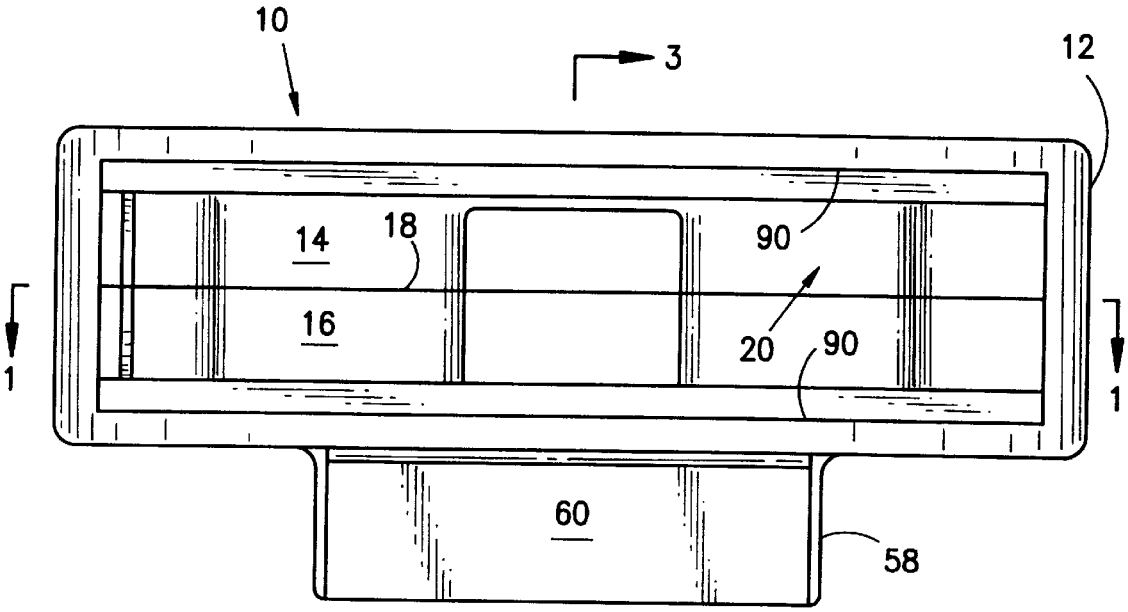
FIG. 2 illustrates a front view.
Figure 3:
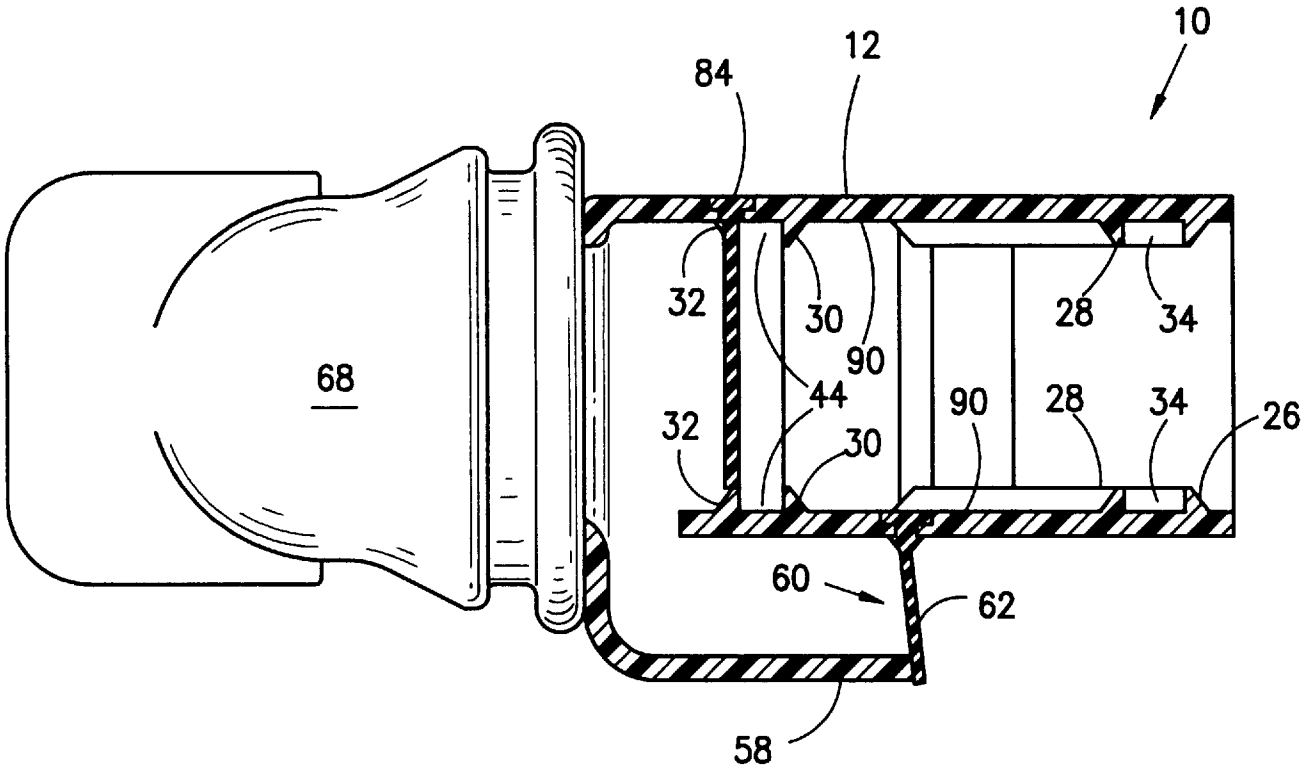
FIG. 3 illustrates a side view along line 3—3 of FIG. 2.
Figure 4:
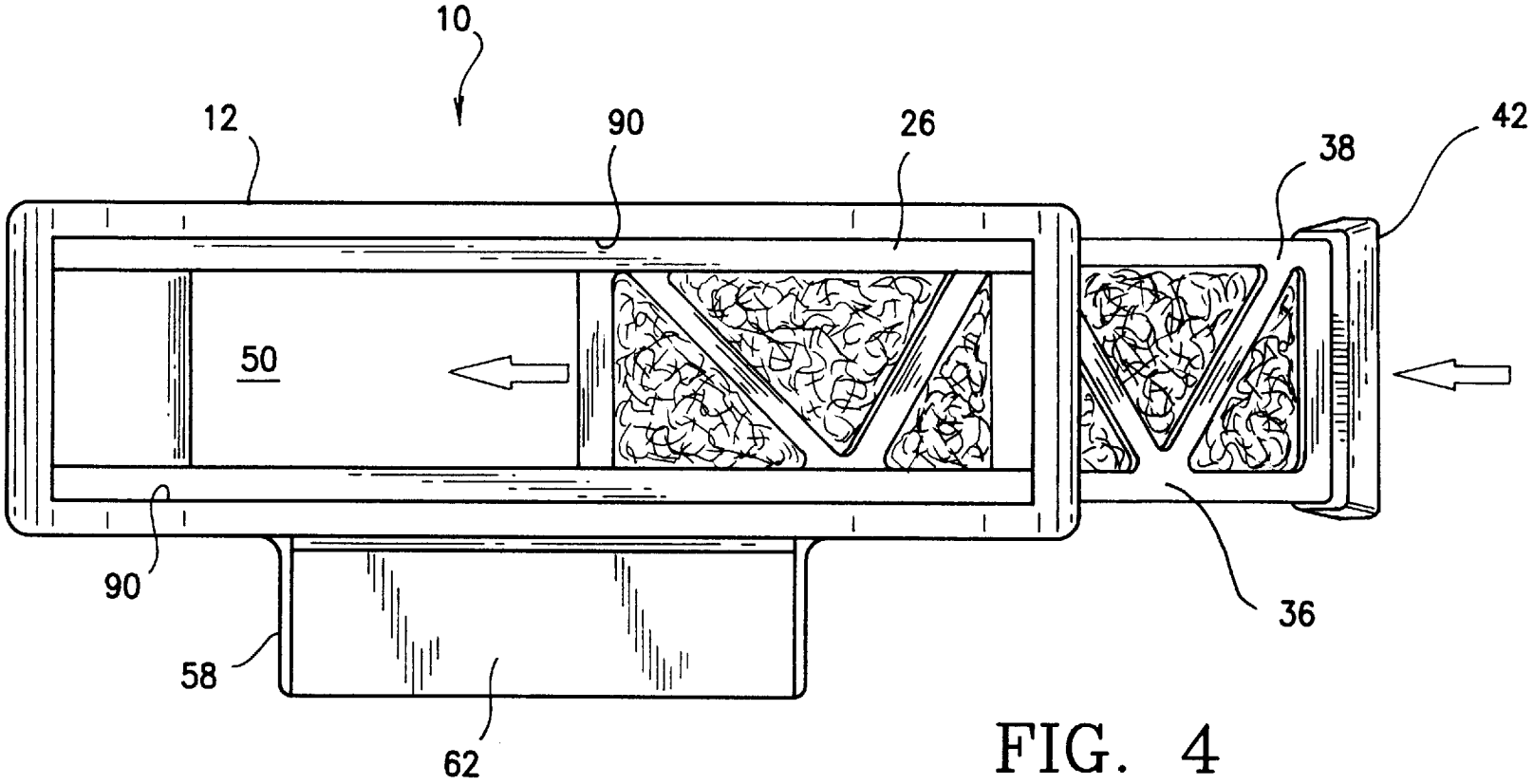
FIG. 4 illustrates the insertion of the first filter cartridge.
Figure 5:
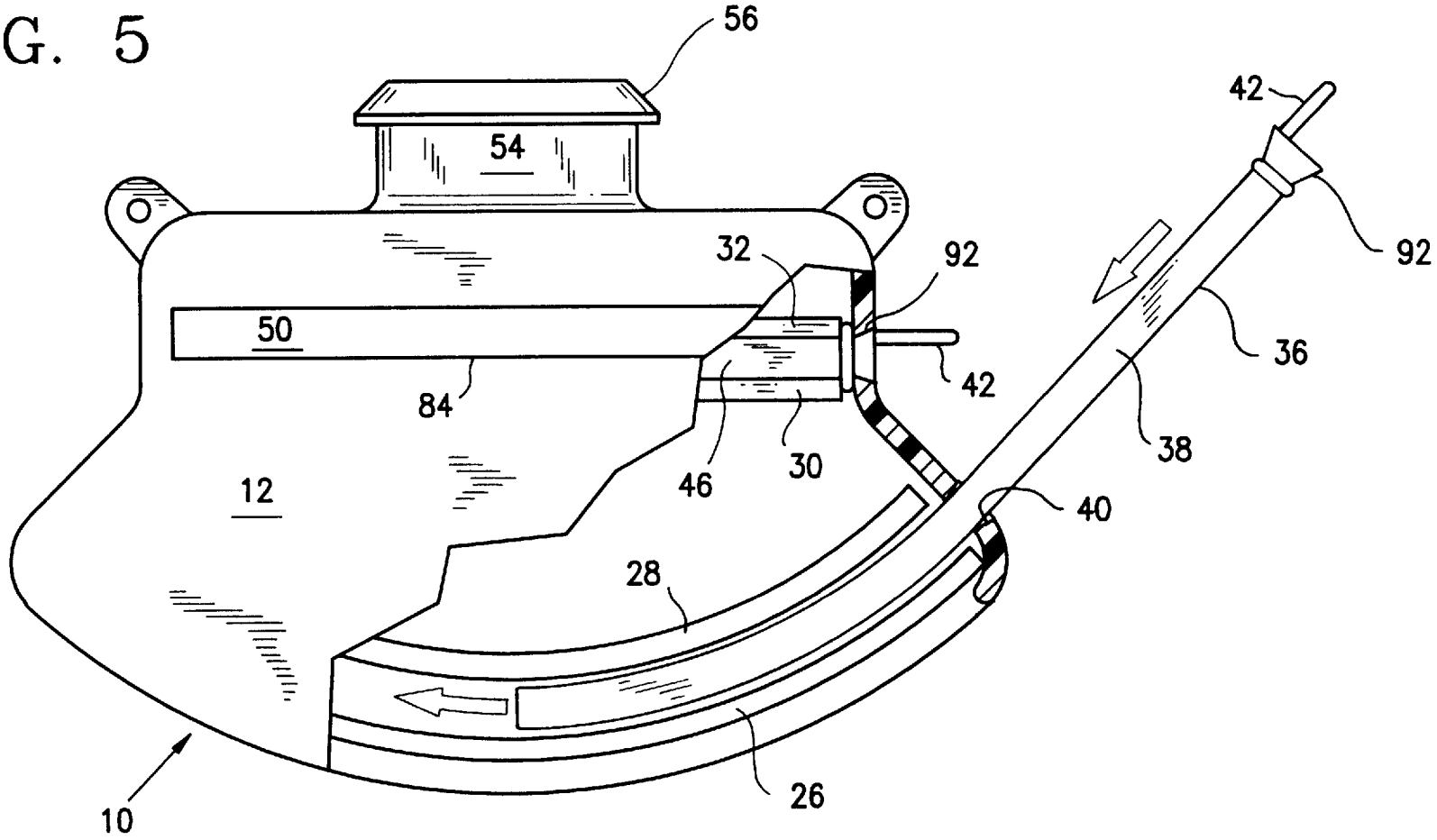
FIG. 5 illustrates a cut away top view.

Referring to FIG. 2, the exercise filter assembly 10 preferably comprises a hollow body 12 formed from upper and lower body sections 14, 16 attached along a center line 18 to define an enclosed cavity within the body 12. The body 12, preferably comprised of molded plastic or other suitable lightweight material, is generally horn or trumpet shaped, tapering outwardly towards a front inlet port 20 that is open to permit air to pass therethrough. Either a completely open surface or a surface having a mesh or grating cover formed thereon to allow the free passage of air through the front of the body 12 is preferred. Referring to FIGS. 1 and 3, the upper and lower body sections 14, 16 are preferably provided with a pair of spaced apart triangular shaped bosses 26, 28 extending inwardly from the inner surfaces 90 of the body 12 to define a first curved slot 34 into which a removable filter 36 can be inserted. A first filter 36, preferably an activated carbon mesh filter or other suitable material, having a flexible frame 38, is inserted into the slot 34 through an aperture 40 in a side wall of the body 12, as shown in FIGS. 4 and 5. Preferably, the bosses 26, 28 are spaced apart by a distance slightly greater than the width of the first flexible filter 36. A small handle 42 that may be grasped the user for inserting or removing the filter 36 from the body 12 is preferably provided at one end of the filter 36.

Referring again to FIGS. 1, 3, 5, and 6, a second set of inwardly extending triangular shaped bosses 30, 32 defines a second slot 44 in the upper and lower body sections 14, 16 for receiving a second removable filter 46 having a generally rigid housing member or frame 48. The filter 46 is preferably formed of glass fiber or other suitable material. The second slot 44, formed in an area of the body 12 having a substantially constant width, permits the second filter 46 to be inserted or removed from the body 12 independently from the first filter 36. A small handle 42 that may be grasped by the user for inserting or removing the filter 46 from the body 12 is preferably provided at one end of the filter 46. Both filters 36 and 46 include air tight gasket seals 92 at thier ends such that both filters 36 and 46 seal airtight into the body 12 to prevent any contaminated air from entering the body 12.

FIG. 3 illustrates a first one way valve 50, preferably formed of a rubber sheet, inserted into a third slot 84 in the upper body section 14, and locked in place behind the second slot 44. The first one way valve 50 permits air to be drawn through the second filter 46 in one direction, but prevents exhaled air from passing through the filter 46 into the dead space 52 between the filters 36, 46 and the body 12 in the other direction.

As shown in FIGS. 1, 5, 6, and 7, the body 12 terminates in a small mouthpiece receiving neck 54 having a tapered annular ring 56 at the proximal end thereof for receiving and securing a mouthpiece to the neck. The body 12 contains a relatively small dead space 64 between the neck 54 and the first one way valve 50 to reduce the amount of air that is trapped within the body 12 (See FIG. 6). The body 12 includes at least one eye hook 82 at its proximal end near the neck 54 to facilitate the attachment of a retaining cord or string (not shown).

Figure 6:
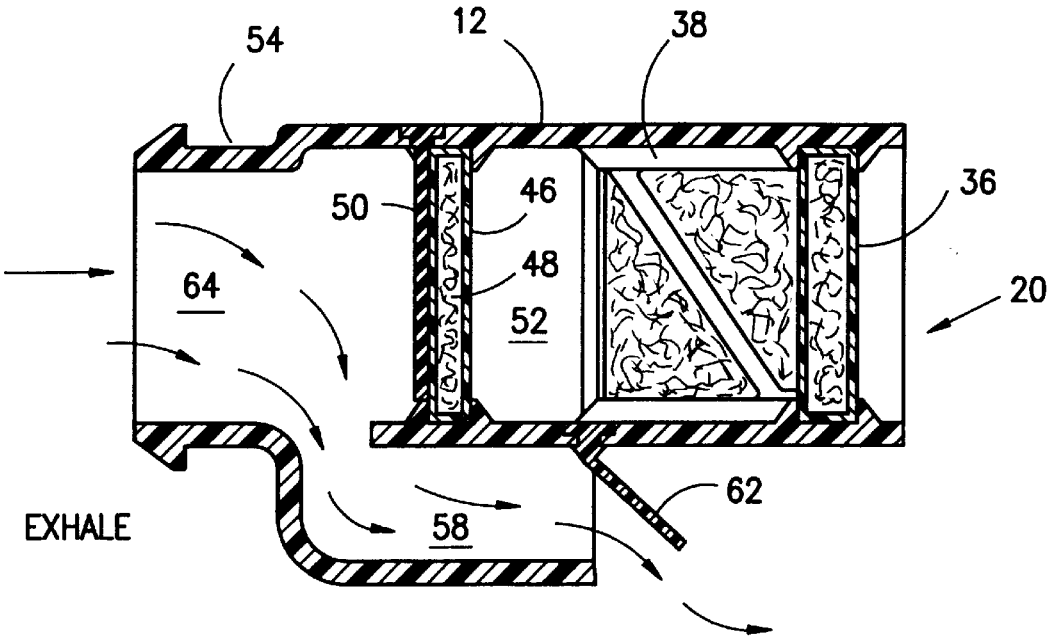
FIG. 6 illustrates a side view showing the filter in an exhalation mode.
Figure 7:
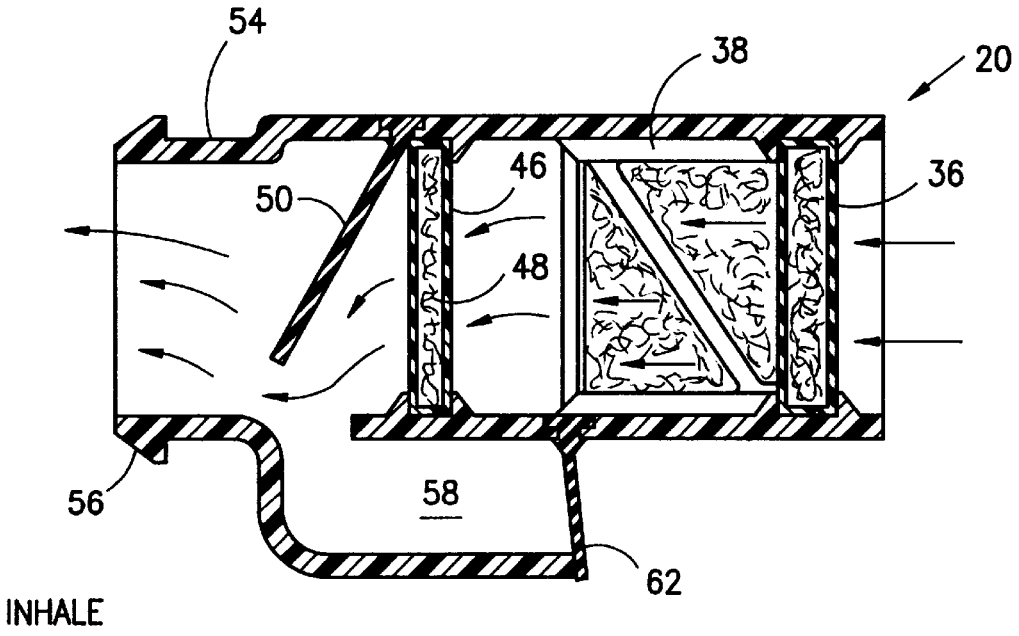
FIG. 7 illustrates a side view showing the filter in an inhalation mode.

A downwardly depending exhaust port 58 having an opening located in the space between the second filter 46 and the neck 54 is formed on the lower housing member 16. Preferably, the exhaust port 58 has a curved channel terminating in an open end 60 facing the front of the body 12 (See FIG. 3). Referring to FIGS. 6 and 7, a second one way valve 62, preferably a rubber flap, is attached to the lower body section 16 and forms a seal with the leading edge of the exhaust port 58. The second one way valve 62 is free to pivot away from the exhaust port 58 and allows air to be exhaled through the port 58 while preventing air from being drawn in through the port 58. In this way, air inhaled through the mouthpiece neck 54 is forced to pass through the first and second filters 36, 46 into the mouthpiece neck 54 while exhaled air is exhausted through the exhaust port 58.

Figure 8:
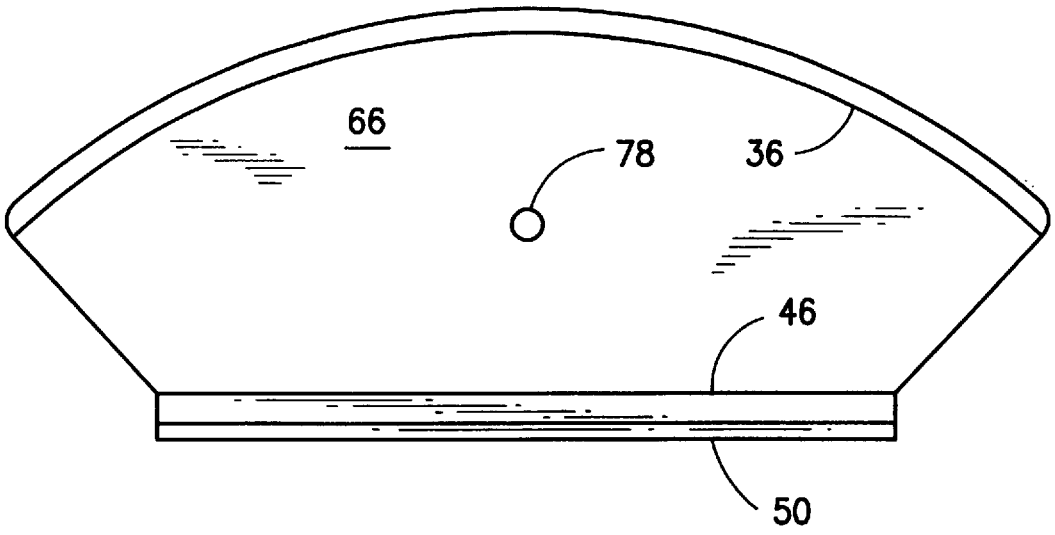
FIG. 8 illustrates a bottom view of an alternative filter cartridge.
Figure 9:
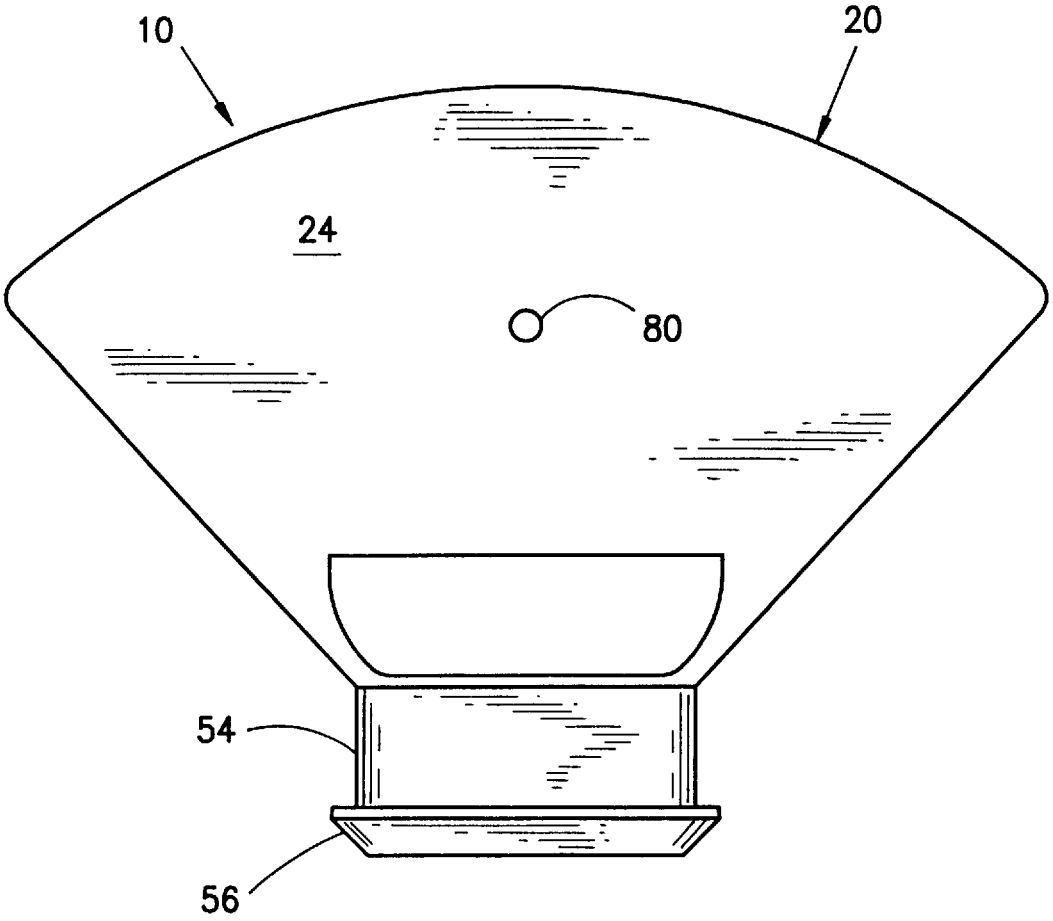
FIG. 9 illustrates a bottom view of an alternative body.

FIG. 9 shows a bottom view of an alternative embodiment 24 of the body 12. The alternative body 24 may be in the trumpet shape (as shown) or in a parabolic, circular or square shape (not shown). The preferred embodiment has a larger inlet port 20 than the neck 54. FIG. 8 illustrates a bottom view of an alternative filter cartridge 66, having a convex front so that it encompasses the entire inlet port 20 of the body 24 when it is inserted into the body 24 via the inlet port 20. The alternative filter cartridge 66 includes the first filter 36, the second filter 46 and the first one way valve 50 permanently affixed in series for unidirectionally allowing the flow of air through the body 24. The alternative filter cartridge 66 includes a pin 78 on its exterior surface which securely locks into an aperture 80 (as shown in FIG. 9) of the body 24 and securely locks the cartridge 66 into the body 24.

Figure 10:
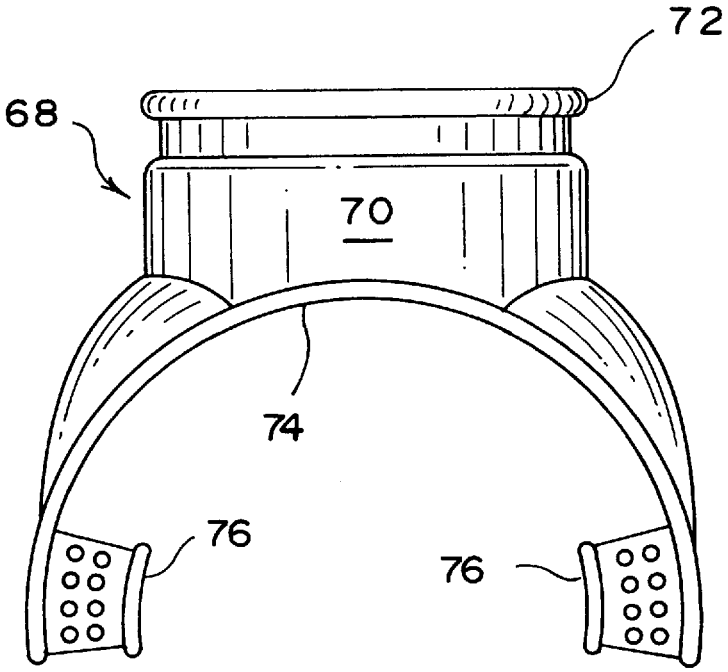
FIG. 10 illustrates a mouthpiece.

FIG. 10 illustrates a mouthpiece 68 which can be attached and removed from the neck 54 of the filter assembly 10. The mouthpiece 68 comprises a body 70 having a ridged edge 72 which can be securely attached to the neck 54 of the body 12. Mouthpiece 68 is preferably made from a mildly hard rubber. The mouthpiece 68 is shaped in the form of a wall 74 to fit between a person's teeth and lips which wraps around said person's teeth from one side to the other. Wall 74 is also slightly arcuate in the up and down dimension of a person's face. Extending inwardly from opposite sides of the wall 74 are a pair of members 76 for fitting between upper and lower teeth to allow a person to bite thereon and better hold the mouthpiece 68.

The invention includes a number of features which result in a comfortable respiratory exercise filter assembly and one in which the integrity is likely to be maintained. Alternatives to various features have been pointed out. It is understood, however, that many other equivalents are available. In that regard, it is understood the changes made, especially in matters of shape, size and arrangement of various components and structure to the full extent of the general meaning of the terms in which the appended claims are expressed, are within the principle of the present invention.

I claim:

1. A filter assembly comprising:

a hollow body formed from upper and lower body sections attached along a center line defining an enclosed cavity having an inlet port, a first removable filter, a second removable filter, and a first one way valve in series for uni-directionally allowing the flow of air through the body such that air passes through the first filter, the second filter and the first one way valve;

an exhaust port having an open end and a second one way valve for unidirectionally exhausting air from the body;

at least one slot formed between a plurality of bosses extending inwardly from the inner surface of the body, and the first one way valve comprising a flap sheet inserted into a slot in the upper housing section approximately behind the second filter.

2. The filter assembly as defined in claim 1 further comprising a front inlet port that is open to permit air to pass therethrough.

3. The filter assembly as defined in claim 1 further comprising a first curved slot defined by the bosses into which a filter may be inserted.

4. The filter assembly as defined in claim 1 further comprising a second slot defined by the bosses extending inwardly from the inner surfaces of the body.

5. The filter assembly as defined in claim 4 whereby the second slot is formed in an area of the body having a substantially constant width.

6. The filter assembly as defined in claim 1 whereby the bosses are triangular in shape.

7. The filter assembly as defined in claim 1 whereby the first filter has a curved flexible frame or cartridge carrying an activated carbon mesh filter.

8. The filter assembly as defined in claim 1 whereby the second filter comprises a generally rigid housing member or frame carrying a glass fiber filter.

9. The filter assembly as defined in claim 1 whereby the second one way valve comprises a rubber sheet attached to the lower body section and forms a seal with the leading edge of the exhaust port.

10. The filter assembly as defined in claim 9 whereby a mouthpiece is attached to the mouthpiece receiving neck of the body.

11. The filter assembly as defined in claim 1 whereby the body terminates in a small mouthpiece receiving neck having a tapered annular ring at the proximal end thereof for receiving and securing a mouthpiece to the neck.

12. The filter assembly as defined in claim 1 whereby the body is trumpet shaped.

13. The filter assembly as defined in claim 12 whereby the filter cartridge includes a pin to securely lock the cartridge into the aperture of the body.

14. The filter assembly as defined in claim 1 whereby a filter cartridge includes both the first and second filters and the first one way valve in series.

15. The filter assembly as defined in claim 1 whereby the body includes an aperture.

16. The filter assembly as defined in claim 1 whereby the first and second filters include a small handle for grasping the filters.

17. The filter assembly as defined in claim 1 whereby the first and second filters include air tight gasket seals at thier ends.

18. The filter assembly as defined in claim 1 whereby the body is comprised of a sturdy, lightweight, molded plastic.

19. The filter assembly as defined in claim 1 wherein the flap sheet is rubber.

20. A filter assembly comprising:

a hollow body defining an enclosed cavity having an inlet port, a first removable filter, a second removable filter, and a first one way valve in series for unidirectionally allowing the flow of air through the body such that air passes through the first filter, the second filter and the first one way valve;

an exhaust port having an open end and second one way valve for unidirectionally exhausting air from the body;

at least one slot located on the inner surface of the body; and a first one way valve comprising a flap sheet inserted into at least one slot in the hollow body approximately behind the second filter.

* * * * *